US008491112B2

(12) United States Patent
Baker et al.

(10) Patent No.: US 8,491,112 B2
(45) **Date of Patent: *Jul. 23, 2013**

(54) INK JET PRINTHEAD CARTRIDGE HAVING AN INK FILL ACCESS PORT IN FLUID COMMUNICATION WITH THE FILTER TOWER

(75) Inventors: Marc Frazier Baker, Georgetown, KY (US); William Bruce Rose, Lexington, KY (US)

(73) Assignee: Funai Electric Co., Ltd. (JP)

( * ) Notice: Subject to any disclaimer, the term of this patent is extended or adjusted under 35 U.S.C. 154(b) by 590 days.

This patent is subject to a terminal disclaimer.

(21) Appl. No.: 12/770,897

(22) Filed: Apr. 30, 2010

(65) Prior Publication Data

US 2010/0238233 A1 Sep. 23, 2010

Related U.S. Application Data

(63) Continuation of application No. 11/752,318, filed on May 23, 2007, now Pat. No. 7,766,470.

(51) Int. Cl.
*B41J 2/175* (2006.01)

(52) U.S. Cl.
USPC ..... 347/87; 347/85

(58) Field of Classification Search
USPC ..... 347/85, 86, 87, 93
See application file for complete search history.

(56) References Cited

U.S. PATENT DOCUMENTS

| | | | | |
|---|---|---|---|---|
| 5,905,518 | A * | 5/1999 | DeFilippis | 347/85 |
| 6,520,630 | B1 * | 2/2003 | Oda et al. | 347/85 |
| 7,766,470 | B2 * | 8/2010 | Baker et al. | 347/87 |
| 7,828,425 | B2 * | 11/2010 | Kang et al. | 347/93 |

* cited by examiner

*Primary Examiner* — Ant T. N. Vo
(74) *Attorney, Agent, or Firm* — Amster, Rothstein & Ebenstein LLP

(57) ABSTRACT

An ink jet printhead cartridge includes a cartridge body including a base and a plurality of side walls extending upwardly from the base. A filter tower having a tower wall has an interior surface that defines a location of a tower passageway. A printhead chip assembly is attached to the base of the cartridge body in fluid communication with the tower passageway. A filter is attached to the filter tower at a distal end thereof. An ink fill access port is formed through a side wall of the plurality of sidewalls, and through the tower wall of the filter tower, to define a fluid path from the atmosphere external to the cartridge body to the tower passageway of the filter tower to facilitate the injection of ink directly into the filter tower during an ink filling operation for the ink jet printhead cartridge.

8 Claims, 2 Drawing Sheets

INK JET PRINTHEAD CARTRIDGE HAVING AN INK FILL ACCESS PORT IN FLUID COMMUNICATION WITH THE FILTER TOWER

This application claims priority and benefit as a continuation application of U.S. Ser. No. 11/752,318, filed May 23, 2007 now U.S. Pat. No. 7,766,470.

BACKGROUND OF THE INVENTION

1. Field of the Invention

The present invention relates to ink jet printhead cartridges, and, more particularly, to an ink jet printhead cartridge having an ink fill access port in fluid communication with the filter tower.

2. Description of the Related Art

An ink jet printhead cartridge combines ink storage and drop ejection functions into a unitary package. The ink jet printhead cartridge includes a body having a base for attachment of a printhead. The ink reservoir may include one or more chambers containing an ink-saturated porous material, such as for example, a polyurethane foam or felt. The printhead includes a nozzle plate having a plurality of ink jetting nozzles, which is attached to a substrate having fluidic passages and chambers for receiving and transporting ink to the ink jetting nozzles, and has selectable electrical components, e.g., heater or piezoelectric elements, which when actuated cause ink to be ejected from one or more of the ink jetting nozzles.

An interconnection between the ink reservoir and the printhead is provided, at least in part, by a tower, sometimes also referred to as a standpipe, which extends upwardly from the base. In order to prevent the introduction of particulate matter and/or air bubbles into the flow path of the interconnection from the ink reservoir to the ink jetting nozzles of the printhead, a filter is typically attached to the tower, and hence, the tower/filter combination is sometimes also referred to as a filter tower assembly. The filter may be in the form of a fine mesh stainless steel filter affixed to the entrance of the tower. The filter also acts as a capillary drain, allowing ink passage upon demand.

Typically, an ink jet printhead cartridge is filled with ink during manufacturing by inserting one or more needles into the porous foam material and injecting a set volume of ink into the porous foam material. Access is typically through the top of the reservoir prior to attaching the lid. Although commercially viable, this process has unnecessary variables that influence the page yield the customer ultimately realizes.

SUMMARY OF THE INVENTION

The terms such as "first" and "second" preceding an element name, e.g., first side wall, etc., are used for identification purposes to distinguish between similar elements, and are not intended to necessarily imply order, nor are the terms "first" and "second" intended to preclude the inclusion of additional similar elements.

The invention, in one form thereof, is directed to an ink jet printhead cartridge. The ink jet printhead cartridge includes a cartridge body including a base and a plurality of side walls extending upwardly from the base. A filter tower having a tower wall has an interior surface that defines a location of a tower passageway. The filter tower has a proximal end and a distal end, the proximal end being attached to the base. A printhead chip assembly is attached to the base of the cartridge body in fluid communication with the tower passageway near the proximal end. A filter is attached to the filter tower at the distal end. An ink fill access port is formed through a first side wall of the plurality of sidewalls, and through the tower wall of the filter tower between the proximal end and the distal end, to define a fluid path from the atmosphere external to the cartridge body to the tower passageway of the filter tower to facilitate the injection of ink directly into the filter tower during an ink filling operation for the ink jet printhead cartridge.

The invention, in another form thereof, is directed to an ink jet printhead cartridge. The ink jet printhead cartridge includes a cartridge body defining a cavity, and having a base. A printhead chip assembly is attached to the base of the cartridge body. An ink suspension body is positioned in the cavity. A lid covers over the cavity. A filter tower is located between the ink suspension body and the printhead chip assembly. The filter tower has an interior surface that defines a location of a tower passageway. The tower passageway is in fluid communication with both the printhead chip assembly and the ink suspension body. A filter is attached to the filter tower adjacent the ink suspension body. An ink fill access port is formed through the cartridge body and through the filter tower to define a fluid path from the atmosphere external to the cartridge body to the tower passageway of the filter tower to facilitate the injection of ink directly into the filter tower during an ink filling operation for the ink jet printhead cartridge.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
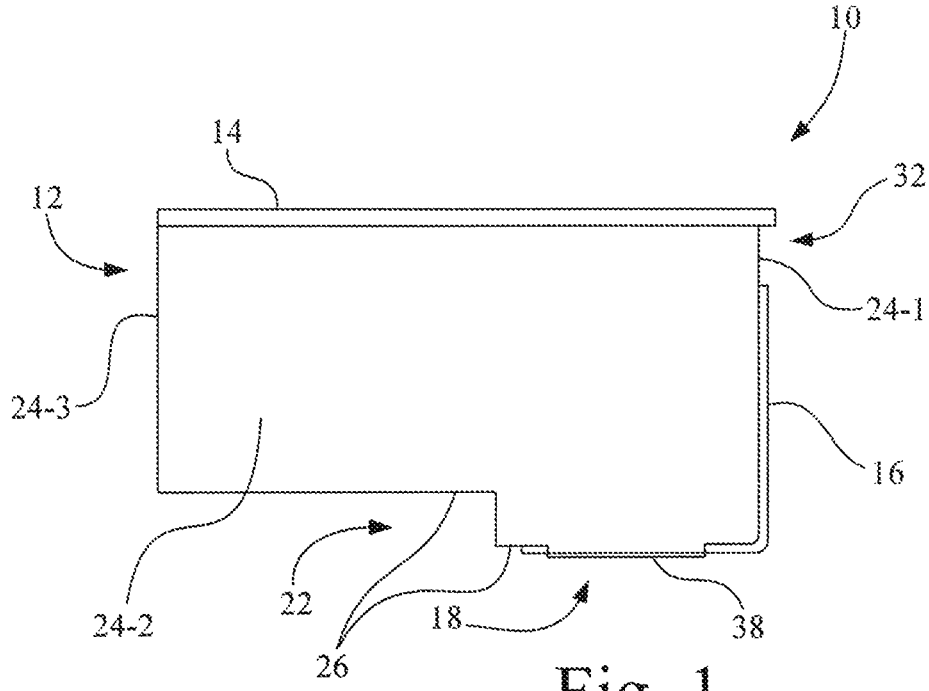
FIG. 1 is a side view of an ink jet printhead cartridge embodying the present invention.
Figure 2:
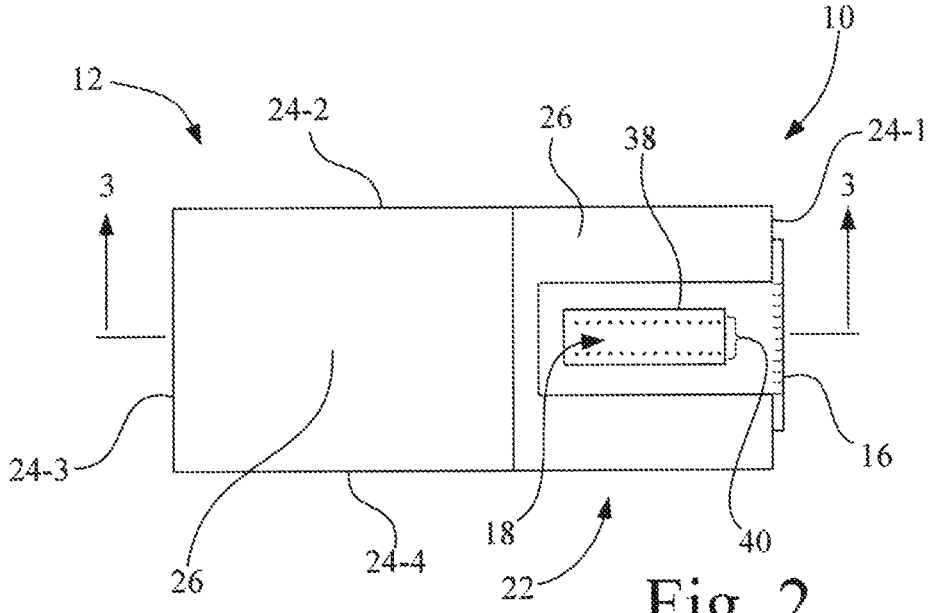
FIG. 2 is a bottom view of the ink jet printhead cartridge of FIG. 1.
Figure 3:
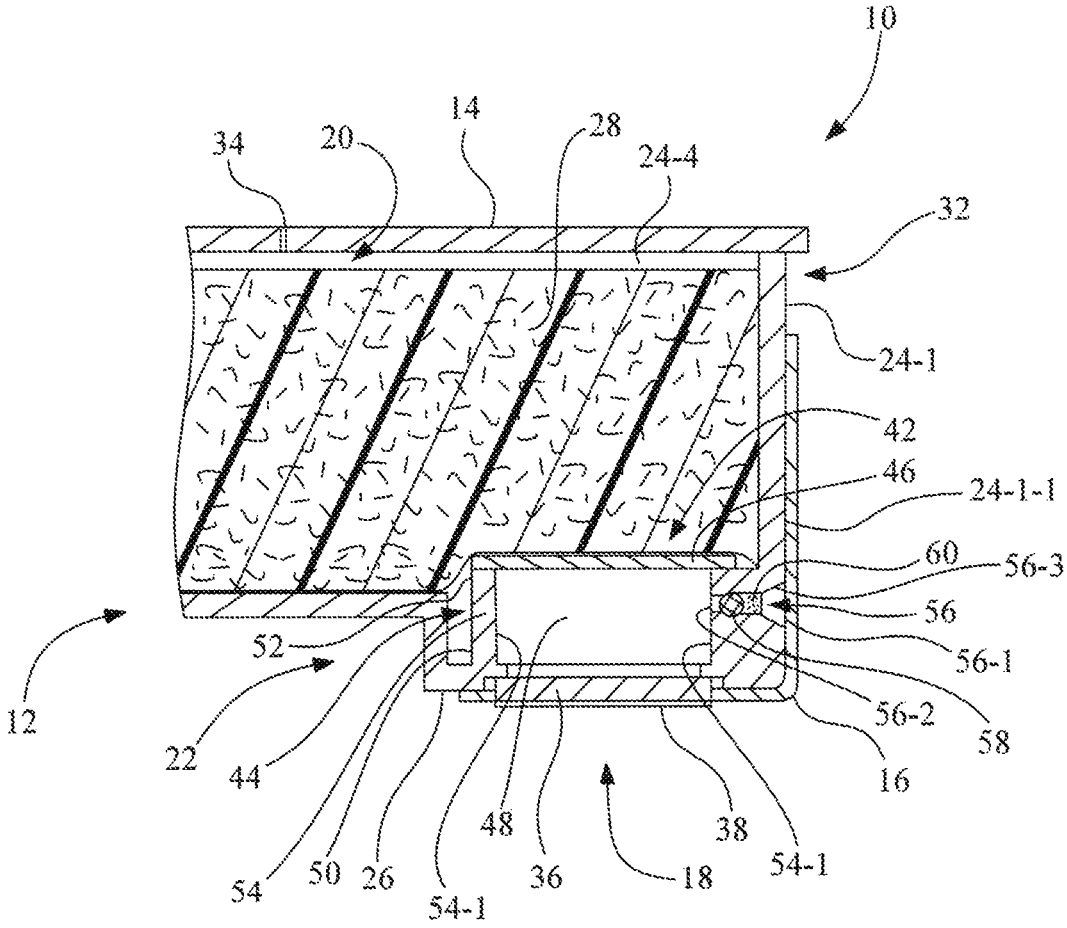
FIG. 3 is a sectional view of ink jet printhead cartridge of FIGS. 1 and 2, taken along line 3-3 of FIG. 2.

Referring now to the drawings and particularly to FIGS. 1-3, there is shown an ink jet printhead cartridge 10 in accordance with an embodiment of the present invention.

Ink jet printhead cartridge 10 includes a cartridge body 12, a lid 14, a flexible electrical interface circuit 16 and a printhead chip assembly 18.

Cartridge body 12 defines a cavity 20 that forms an ink reservoir for holding a supply of ink, and includes a snout portion 22 to which printhead chip assembly 18 is attached. Cartridge body 12 may be formed, for example, from a polymer material during an injection molding process. Cartridge body 12 includes a plurality of side walls individually identified as side walls 24-1, 24-2, 24-3 and 24-4 that extend upwardly from a base 26. Inserted into cavity 20 is an ink suspension body 28, such as a porous foam or felt, for holding ink. Lid 14 is attached to distal ends 32 of side walls 24-1, 24-2, 24-3 and 24-4 to cover over, i.e., enclose, cavity 20. An air vent 34 may extend from the atmosphere external to ink jet printhead cartridge 10 through lid 14 to cavity 20.

Printhead chip assembly 18 includes a substrate, e.g., a silicon chip, 36 having a plurality of ink passages and chambers for receiving and transporting ink. A nozzle plate 38 having a plurality of ink jetting nozzles 40 is attached to substrate 36, with the plurality of ink jetting nozzles 40 being in fluidic communication with the chambers of substrate 36. Formed on substrate 36, and associated with each of the plurality of ink jetting nozzles 40, is a selectable electrical component, e.g., heater or piezoelectric elements, electrically connected with corresponding electrical conductors of flexible electrical interface circuit 16. Flexible electrical interface circuit 16 may be, for example, a tape automated bonding (TAB) circuit or other flexible interconnection device. Flexible electrical interface circuit 16 is attached to printhead chip assembly 18 at base 26, and extends around to, and is attached to, side wall 24-1. Flexible electrical interface circuit 16 includes electrical contact pads located adjacent side wall 24-1 that are electrically connected to its electrical conductors to facilitate electrical communication between an ink jet printing apparatus and printhead chip assembly 18 when ink jet printhead cartridge 10 is loaded into the ink jet printing apparatus.

At snout portion 22, extending upwardly from base 26 into cavity 20 is a filter tower assembly 42. Filter tower assembly 42 includes a filter tower 44 and a filter 46. Filter tower assembly 42 defines a tower passageway 48 that serves as a fluid conduit that leads from an ink reservoir to fluid jetting nozzles.

Filter tower 44 has a proximal end 50 and a distal end 52, and may be formed as an upwardly extending tower wall 54, which may include multiple wall portions, having an interior surface 54-1 that defines the location of tower passageway 48, and in one embodiment, for example, may be formed as an upstanding cylinder. Proximal end 50 of filter tower 44 is attached to, or formed integral with, base 26 of cartridge body 12, and in the embodiment shown, is formed integral with base 26 during an injection molding operation that forms cartridge body 12.

Filter 46 is attached to the distal end 52 of filter tower 44, and is positioned to be adjacent ink suspension body 28. Filter 46 may be attached to the distal end 52 of filter tower 44, for example, by heat staking or adhesive methods, and extends over tower passageway 48. Filter 46 may be formed, for example, as a porous material, such as a fine-mesh screen. The screen material for filter 46 may be, for example, a metal (e.g., stainless steel) or plastic.

Prior to installation of flexible electrical interface circuit 16 on cartridge body 12 of ink jet printhead cartridge 10, an ink fill access port 56 is formed through a tower wall of filter tower 44 to define a fluid path from external atmosphere external to the tower passageway 48. Ink fill access port 56 may be formed, for example, by molding a feature in cartridge body 12 or by drilling a hole. Ink fill access port 56 defines an outer opening 56-1 adjacent an outer surface 24-1-1 of side wall 24-1 and an inner opening 56-2 adjacent interior surface 54-1 of filter tower 44.

During an ink filling operation, ink is injected, e.g., by one or more needles, through ink fill access port 56, which is in fluid communication with tower passageway 48. It is desirable that the ink used to fill ink jet printhead cartridge 10 be properly filtered prior to injection to reduce the possibility of particulate contamination. The injected ink fills tower passageway 48, and then flows through filter 46 into cavity 20, and more particularly into ink suspension body 28 located in the ink reservoir formed by cavity 20. Thus, ink fill access port 56 provides an ink fill access point at an exterior side wall 24-1 of ink jet printhead cartridge 10, and facilitates the injection of ink directly into filter tower 44.

By injecting the ink directly into filter tower passageway 48, filter tower 44 is consistently filled first before the ink charge flows into ink suspension body 28 in the reservoir of cavity 20. The flow resistance of filter 46 restricts the ink from flowing into ink suspension body 28 until tower passageway 48 is fully filled. If ink jet printhead cartridge 10 is oriented during filling with nozzle plate 38 above, i.e., higher than, ink fill access port 56, then trapped air within filter tower 44 and printhead chip assembly 18 will be forced out through a plurality of ink jetting nozzles 40 before the ink meniscus forms over the ink jetting nozzles 40 of nozzle plate 38. This in turn reduces the amount of trapped air in ink jet printhead cartridge 10, and may reduce, or in some cases eliminate, the need to prime or vacuum purge the cartridge during the manufacturing process.

Once the ink fill operation is complete, a sealing ball 58 is forced, e.g., pressed, into ink fill access port 56 through outer opening 56-1 to seal ink fill access port 56. In other words, sealing ball 58 is positioned in ink fill access port 56 between outer opening 56-1 and inner opening 56-2 for sealing ink fill access port 56 after ink is injected through ink fill access port 56 into cartridge body 12. To aid the insertion of sealing ball 58, an outer portion 56-3 adjacent outer opening 56-1 of ink fill access port 56 may be flared to a larger diameter. If necessary, or desired, a potting material 60, such as an adhesive, may be injected behind sealing ball 58 into ink fill access port 56 to supplement the sealing effect of sealing ball 58. Potting material 60 may be effective in preventing the loosening of sealing ball 58 in ink fill access port 56, and thus aid in preventing any seepage of ink out of ink fill access port 56.

Once the sealing ball 58, and any desired potting material 60, is inserted into ink fill access port 56, then flexible electrical interface circuit 16 is folded and permanently adhered to cartridge body 12. Thus, flexible electrical interface circuit 16 may be used to conceal any perceived negative industrial design aesthetic aspects of having ink fill access port 56 on side wall 24-1. It may be desirable that the section of flexible electrical interface circuit 16 that is tented over outer opening 56-1 of ink fill access port 56 be free of electrical contact pads, but that section of flexible electrical interface circuit 16 may include electrical conductors, thereby fully utilizing the area of flexible electrical interface circuit 16.

Accordingly, with the present invention direct access to ink suspension body 28 in the reservoir of cavity 20 during an ink filling operation is not necessary. It other words, it is not necessary to inject the ink directly into the ink suspension body forming a porous foam reservoir.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. An ink jet printhead, comprising:

a cartridge body defining an ink reservoir for holding a supply of ink in a suspension body residing in a cavity;

a filter tower with a tower wall defining an interior surface for a location of a tower passageway;

a printhead chip assembly connected in fluid communication with said tower passageway, said filter tower defining a fluid conduit from the ink reservoir to the printhead chip assembly;

a filter positioned in said filter tower for filtering fluid flowing thereby; and an ink fill access port formed through the tower wall to define a re-sealable fluid path from atmosphere external to said tower passageway of said filter tower to facilitate the injection of ink directly into said filter tower during an ink filling operation for said ink jet printhead, wherein the ink fill access port resides beneath the ink reservoir and filter and above the printhead chip assembly during use to eject fluid downward from the printhead chip assembly.

2. The ink jet printhead of claim 1, wherein the filter is a porous material.

3. The ink jet printhead of claim 1, further including a nozzle plate with the printhead chip assembly including a plurality of ink jetting nozzles, wherein during said ink filling operation said ink jet printhead is configured to be oriented with said nozzle plate gravitationally higher than said ink fill access port to allow air trapped within said filter tower and said printhead chip assembly to be forced out through said plurality of ink jetting nozzles before an ink meniscus forms over said plurality of ink jetting nozzles of said nozzle plate.

4. The ink jet printhead of claim 1, further including an air vent in fluid communication with atmosphere.

5. A method of injecting ink into an ink jet printhead having a filter tower defining a fluid conduit from an ink reservoir to a printhead chip assembly, the filter tower further having a re-sealable ink fill access port, the ink jet printhead having a cartridge body defining the ink reservoir for holding a supply of ink in a suspension body residing in a cavity and the filter tower further having a filter adjacent and in fluid communication with the suspension body wherein the ink fill access port resides beneath the ink reservoir and filter and above the printhead chip assembly during use to eject fluid downward from the printhead chip assembly, comprising:

unsealing the re-sealable ink fill access port, thereby exposing the filter tower to atmospheric pressure;

supplying a refill volume of ink through the ink fill access port between the printhead chip assembly and the ink reservoir directly into a tower passageway of the filter tower until ink seeps out of the tower passageway; and sealing the ink fill access port.

6. The method of claim 5, further including orienting the printhead chip assembly gravitationally higher than the filter tower before the supplying the refill volume of ink.

7. The method of claim 5, further including pushing a needle through the ink fill access port until at least a portion of the needle is disposed in the tower passageway inside the filter tower.

8. The method of claim 7, further including forcing ink though the needle until the tower passageway is filled and the ink seeps out of the tower passageway and into an ink suspension body disposed within the cartridge.

* * * * *